US008308164B2

(12) United States Patent
Castillo

(10) Patent No.: US 8,308,164 B2
(45) Date of Patent: Nov. 13, 2012

(54) SCALLYWAGS BOARD GAME

(76) Inventor: Marijayne Castillo, Vallejo, CA (US)

( * ) Notice: Subject to any disclaimer, the term of this patent is extended or adjusted under 35 U.S.C. 154(b) by 0 days.

(21) Appl. No.: 13/011,020

(22) Filed: Jan. 21, 2011

(65) Prior Publication Data

US 2012/0187627 A1 Jul. 26, 2012

(51) Int. Cl.
*A63F 3/00* (2006.01)

(52) U.S. Cl. ..... 273/243; 273/354

(58) Field of Classification Search ..... 273/243, 273/252, 254
See application file for complete search history.

(56) References Cited

U.S. PATENT DOCUMENTS 3,874,671 A * 4/1975 Smith ..... 273/254
4,093,235 A * 6/1978 Barry ..... 273/254
5,058,896 A * 10/1991 Bez ..... 273/272
5,460,381 A * 10/1995 Smith et al. ..... 273/238
5,511,792 A * 4/1996 Simmons et al. ..... 273/251
5,722,834 A * 3/1998 Rivera et al. ..... 434/128
5,924,695 A * 7/1999 Heykoop ..... 273/459
6,474,647 B1 * 11/2002 Zakhar ..... 273/292
7,219,894 B2 * 5/2007 Stewart et al. ..... 273/236
2003/0030214 A1 * 2/2003 Marlin ..... 273/254
2004/0176157 A1 * 9/2004 Walker et al. ..... 463/16
2008/0252006 A1 * 10/2008 Johnson ..... 273/241
2009/0152812 A1 * 6/2009 Derrick ..... 273/236

* cited by examiner

*Primary Examiner* — Vishu K. Mendiratta
(74) *Attorney, Agent, or Firm* — Jerry D. Haynes; Law Office of Jerry D. Haynes, P.A.

(57) ABSTRACT

An interactive pirate themed board game comprising: a pirate ship shaped game board; a plurality of spaces on the game board, where said plurality of spaces are arranged in a plurality of levels; a starting position, where said starting position is at a lowest level of the plurality of levels; and a finishing position, where said finishing position is at a highest level of the plurality of levels. A plurality of pirate related paraphernalia, pirate related activity or penalties may be associated with the plurality of spaces, where the plurality of pirate related paraphernalia includes at least swords, eye patch, telescope, scarf, markers, coins and earrings. The winning player of the interactive pirate themed board game may be awarded a captain's hat and a stuffed parrot after reaching the finishing position.

8 Claims, 1 Drawing Sheet

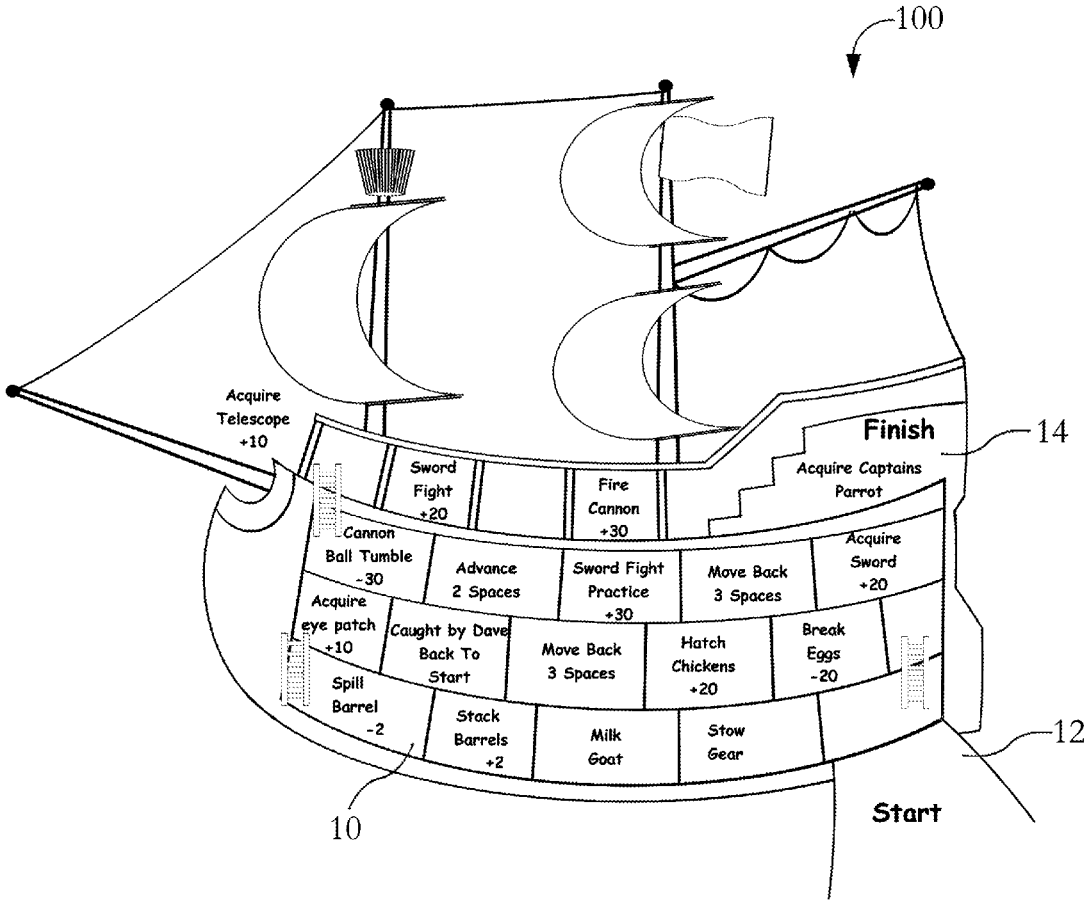
100
Acquire Telescope +10
Sword Fight +20
Fire Cannon +30
Finish
Acquire Captains Parrot
14
Cannon Ball Tumble -30
Advance 2 Spaces
Sword Fight Practice +30
Move Back 3 Spaces
Acquire Sword +20
Acquire eye patch +10
Caught by Dave Back To Start
Move Back 3 Spaces
Hatch Chickens +20
Break Eggs -20
Spill Barrel -2
Stack Barrels +2
Milk Goat
Stow Gear
12
10
Start

SCALLYWAGS BOARD GAME

BACKGROUND OF THE INVENTION

1. Field of Invention

The present invention relates to an interactive pirate-theme board game that involves role-playing.

2. Description of Related Art

Multiple board games are available for adults and children for fun, entertainment and intrigue. A typical board game involves movement of counters or pieces across the board where moves are determined by spinning a wheel, tossing a die or based upon predetermined conditions associated with movements. Some the more common board games include checkers, Scrabble, Monopoly and Life to name a few. A board game may involve a combination of luck, strategy and diplomacy. The luck element is usually associated with a roll of dice or a spin of the wheel to determine movement across the board. For example, the roll of the dice may force a player to receive an appropriate number of movements so that they may be rewarded with an element associated with the board game or the roll may be detrimental to the player's objective. Other more complex board games may involve certain strategies such as chess for example. In terms of strategy, players may need to implement a certain amount of strategy in order to overcome any bad rolls of the dice or spins of the wheel. Board games may also involve diplomacy where players may need to negotiate with other players in making deals or compromising to exchange assets or positions in relation to the board game.

A board game usually involves a common board with a series of spaces that determine the results and outcome of a game. Normally each player is given a game piece or token to move across the board. The board often includes a multiple spaces for movement of the game pieces and a means to determine the movement of the pieces such as dice, a spinning wheel, or a pull of cards.

Specific board games exist that may be associated with a theme or style that is associated with the game such as word games, war games, racing games, games associated with fairy tales or a make believe scenario. A number of board games are associated with pirate related themes. In particular pirate related games are usually associated with stories such as Treasure Island, Davy Jones or Captain Hook for example. Pirate theme games consequently include pirate-related activity, costumes and paraphernalia associated with a pirate. Such items include a pirate ship, swords, eye patch, the captain's hat, parrots, a plank extending from a pirate ship, pirate hats, scarves, telescopes and gold coins that may be associated with a booty seized by pirates. It would therefore be advantageous to develop a unique game suitable for children that provides an interactive board game with a pirate theme.

SUMMARY OF THE INVENTION

The present invention relates to an interactive pirate themed board game comprising: a pirate ship shaped game board; a plurality of spaces on the game board, where said plurality of spaces are arranged in a plurality of levels; a starting position, where said starting position is at a lowest level of the plurality of levels; and a finishing position, where said finishing position is at a highest level of the plurality of levels. A plurality of pirate related paraphernalia may be associated with a portion of the plurality of spaces where the plurality of pirate related paraphernalia includes at least swords, eye patch, telescope, scarf, markers, coins and earrings. In addition to paraphernalia, a plurality of pirate related activity may be associated with a portion of the plurality of spaces and a plurality of penalties may also be associated with a portion of the plurality of spaces. The winning player of the interactive pirate themed board game may be awarded a captain's hat and a stuffed parrot after reaching the finishing position.

BRIEF DESCRIPTION OF DRAWINGS

FIG. 1 depicts a game board of a pirate themed board game according to the present invention.

DETAILED DESCRIPTION

The present invention relates to an interactive pirate themed board game designed to provide a pirate themed board game for children. The board game according to the present invention provides a form of entertainment for young children in the form of a non-gender specific game. The pirate theme board game according to present invention allows children to role-play as pirates while moving pieces across the board. Players move pieces move across the board that enable them to role play as a pirate and gain paraphernalia associated with a pirate's lifestyle. The objective of the pirate themed game according to the present invention is to acquire the captain's position where the winner is crowned captain with the captain's hat and receive a stuffed parrot.

A Game Board 100 is depicted in FIG. 1 which is associated with the pirate themed board game according to the present invention. A plurality of spaces 10 are provided across an image of a pirate's ship that relate to pirate-themed activities and paraphernalia that may be acquired while moving across the Game Board 100. The game board 100 includes a Start Position 12 and a Finish Position 14. Each player starts at the Start Position 12 and moves along each level of the pirate ship. The players may gain possession of pirate-related paraphernalia while moving across the Game Board 100. The paraphernalia available over the board increases in value and note worthiness as the players move to each level of the pirate ship. Examples of paraphernalia that may be acquired while playing the board game according to the present invention include: swords, eye patch, telescope, scarf, markers, coins and earrings. Also the spaces on the board may be associated with activities associated with pirate lifestyles such as sword fights, firing a cannon, stacking barrels of stock and acquiring basic gear associated with the pirate ship and lifestyle. The spaces lead to the Finish 14 and may also be associated with penalties where if the player moves on a penalty space, the player may be required to move backward or even have to start at the beginning at the Start Position 12.

In addition to the board, pirate paraphernalia may be provided with the board game so that the players may physically acquire the paraphernalia while actively playing the board game. Therefore an actual captain's ship with swords, eye patches, telescopes, earrings, captain's hat, compass and other paraphernalia may be provided and associated with the board game according to the present invention. Once the winning player achieves the Finish Position 14, the winning player acquires the captain's hat and the stuffed parrot which is the end object of the pirate-theme board game according to the present invention.

The pirate-theme board game according to present invention provides an alternative for a player interactive participating non-gender game for children. The pirate-theme board game according to present invention encourages young children to role-play, dress up and engage in a social conversation within a pirate-themed board game. The pirate-themed board game according to present invention therefore may provide many hours of fun and entertainment for young school-age children. The instant invention has been shown and described in what it considers to be the most practical and preferred embodiments. It is recognized, however, that departures may be made there from within the scope of the invention and that obvious modifications will occur to a person skilled in the art.

What is claimed is:

1. An interactive pirate themed board game comprising:

a. A pirate ship shaped game board;

b. A plurality of spaces on the game board, where said plurality of spaces are arranged in a plurality of levels;

c. a plurality of physically acquired pirate related paraphernalia is provided as a player moves along the plurality of spaces on the game board, where said plurality of pirate related paraphernalia includes at least swords, eye patch, telescope, scarf, markers, coins and earrings;

d. a starting position, where said starting position is at a lowest level of the plurality of levels; and e. a finishing position, where said finishing position is at a highest level of the plurality of levels, and where said finishing position is associated with physically receiving at least one object and with winning the interactive pirate themed board game, where the at least one object includes one of at least a captain's hat and a stuffed parrot.

2. The interactive pirate themed board game according to claim 1, where a plurality of pirate related paraphernalia is associated with a portion of the plurality of spaces.

3. The interactive pirate themed board game according to claim 1, where a plurality of pirate related activity is associated with a portion of the plurality of spaces.

4. The interactive pirate themed board game according to claim 1, where a plurality of penalties is associated with a portion of the plurality of spaces.

5. The interactive pirate themed board game according to claim 1, where said finishing position is a helm of the pirate ship.

6. The interactive pirate themed board game according to claim 1, where said plurality of physically acquired pirate related paraphernalia includes at least swords, eye patch, telescope, earrings, captain's hat, and compass.

7. The interactive pirate themed board game according to claim 4, where the plurality of penalties includes requiring the player to move backwards along the board game.

8. The interactive pirate themed board game according to claim 7, where the plurality of penalties further includes requiring the player to go back to the start position.

* * * * *